US007393084B2

(12) United States Patent
Saito et al.

(10) Patent No.: US 7,393,084 B2
(45) Date of Patent: Jul. 1, 2008

(54) SUBSTRATE FOR INK JET HEAD WITH TACR ALLOY PROTECTIVE LAYER, INK JET HEAD UTILIZING THE SAME AND PRODUCING METHOD THEREFOR

(75) Inventors: Ichiro Saito, Yokohama (JP); Sakai Yokoyama, Kawasaki (JP); Teruo Ozaki, Yokohama (JP); Toshiyasu Sakai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 98 days.

(21) Appl. No.: 10/534,906

(22) PCT Filed: Dec. 25, 2003

(86) PCT No.: PCT/JP03/16712

§ 371 (c)(1),
(2), (4) Date: May 16, 2005

(87) PCT Pub. No.: WO2004/060681

PCT Pub. Date: Jul. 22, 2004

(65) Prior Publication Data

US 2006/0061626 A1 Mar. 23, 2006

(30) Foreign Application Priority Data

Dec. 27, 2002 (JP) ..... 2002-380822
Dec. 27, 2002 (JP) ..... 2002-380823
Dec. 11, 2003 (JP) ..... 2003-413498

(51) Int. Cl.
*B41J 2/05* (2006.01)

(52) U.S. Cl. ..... 347/63; 347/64

(58) Field of Classification Search ..... 347/20, 347/56–59, 61–65, 67
See application file for complete search history.

(56) References Cited

U.S. PATENT DOCUMENTS 4,596,994 A * 6/1986 Matsuda et al. ..... 347/64
6,467,884 B1 10/2002 Murooka et al. ..... 347/64
6,485,131 B1 11/2002 Saito et al. ..... 347/64
2002/0024564 A1 2/2002 Ozaki et al. ..... 347/64
2006/0033778 A1 2/2006 Shibata et al. ..... 347/59
2006/0033779 A1 2/2006 Shibata et al. ..... 347/59

FOREIGN PATENT DOCUMENTS

| | | |
|---|---|---|
| EP | 0 609 860 | 8/1994 |
| EP | 1 078 758 | 2/2001 |
| EP | 1 090 758 | 4/2001 |
| EP | 1 090 760 | 4/2001 |
| EP | 1 177 899 | 2/2002 |
| JP | 6-286149 | 10/1994 |

OTHER PUBLICATIONS

Patent Abstracts of Japan, abstract corresponding to JP 2002-113870 (Apr. 16, 2002).
Patent Abstracts of Japan, abstract corresponding to JP 2001-171126 (Jun. 26, 2001).

(Continued)

*Primary Examiner*—Juanita D Stephens
(74) *Attorney, Agent, or Firm*—Fitzpatrick, Cella, Harper & Scinto

(57) ABSTRACT

For improving adhesion between a protective layer having a portion coming into contact with ink in a substrate for an ink jet head, and a resin layer thereby ensuring reliability in quality over a prolonged period, the invention provides a substrate for an ink jet head including a heat-generating resistor constituting a heat generating portion, an electrode wiring electrically connected with the heat-generating resistor and an upper protective layer provided on the heat-generating resistor and the electrode wiring across an insulating protective layer, wherein after forming an upper protective layer in which a Ta layer is laminated on a layer formed by a TaCr alloy, said Ta layer is selectively patterned and selectively removed so that the liquid flow path member is formed in a portion where the layer formed by said TaCr alloy is exposed by said removing.

33 Claims, 7 Drawing Sheets

OTHER PUBLICATIONS

Patent Abstracts of Japan, abstract corresponding to JP 2001-130003 (May 15, 2001).

Patent Abstracts of Japan, abstract corresponding to JP 2001-105596 (Apr. 17, 2001).

* cited by examiner

SUBSTRATE FOR INK JET HEAD WITH TACR ALLOY PROTECTIVE LAYER, INK JET HEAD UTILIZING THE SAME AND PRODUCING METHOD THEREFOR

TECHNICAL FIELD

The present invention relates to a substrate for an ink jet head for recording or printing a character, a symbol or an image by discharging a functional liquid such as ink on a recording medium including paper, plastic sheet, cloth or article, an ink jet head employing such substrate and a producing method therefor.

BACKGROUND ART

A general configuration of a head employed in ink jet recording includes plural discharge ports, ink flow paths communicated with such discharge ports, and plural electrothermal converting elements for generating thermal energy to be utilized for ink discharge. The electrothermal converting elements are constituted by heat-generating resistors and electrodes for supplying electric power to the heat-generating resistors, and such electrothermal converting elements are covered by an insulation film to secure insulation among the electrothermal converting elements. Each ink flow path communicates, at an end opposite to the discharge port, with a common liquid chamber which stores an ink supplied from an ink tank as an ink reservoir. The ink supplied to the common liquid chamber is guided to each ink flow path, and is retained by forming a meniscus in the vicinity of the discharge port. In this state, the electrothermal converting element is selectively driven to generate thermal energy, which is utilized for causing a rapid bubbling of the ink on a heat acting surface, whereby the ink is discharged by a pressure resulting from such state change.

The heat acting portion of the ink jet head in such ink discharge is exposed to a high temperature generated by heating of the heat-generating resistor, and is also subjected mainly to a composite action of an impact of a cavitation resulting from bubble formation and contraction of the ink, and a chemical action by the ink.

Therefore, the heat acting portion is usually provided with an upper protective layer for protecting the electrothermal converting element from such impact by cavitation and such chemical action of the ink.

Conventionally, a Ta film, relatively strong against the impact by cavitation and the chemical action of the ink, is formed with a thickness of 0.2 to 0.5 μm for realizing a service life and a reliability of the head at the same time.

Also in such heat acting portion, there results a phenomenon that a coloring material or an additive substance contained in the ink is decomposed in a molecular level by heating to a high temperature to form a difficultly soluble substance which is physically adsorbed on the upper protective layer. This phenomenon is called kogation. Such adsorption of the difficultly soluble organic or inorganic substance on the upper protective layer causes an uneven heat conduction from the heat-generating resistor to the ink, thereby resulting in an unstable bubble generation. Therefore an excellent Ta film, relatively free from kogation, is employed ordinarily.

In the following, a mode of generation and extinction of a bubble in the ink in the heat action part will be explained with reference to FIG. 8.

In FIG. 8, a curve (a) indicates a change in time of a surface temperature of the upper protective layer, from a moment of application of a voltage to the heat-generating resistor, with a driving voltage $V_{op}=1.3\times V_{th}$ ($V_{th}$ being a threshold voltage for bubble generation of the ink), a driving frequency of 6 kHz and a pulse width of 5 μs. Also a curve (b) indicates a growth state of a bubble generated from a moment of a voltage application to the heat-generating resistor. As indicated by the curve (a), a temperature rise starts from the voltage application, then a temperature peak is reached with a certain delay from a predetermined pulse time (because the heat from the heat-generating resistor arrives at the upper protective layer with a delay), and the temperature is lowered thereafter mainly by a heat diffusion. On the other hand, as shown by the curve (b), a bubble starts to grow at a temperature of the upper protective layer of about 300° C., then reaches a maximum bubble state and vanishes. In an actual head, this process is executed in a repeated manner. With a bubble generation in the ink, the surface of the upper protective layer rises for example to about 600° C., and this indicates how a thermal action of a high temperature is involved in the ink jet recording.

Consequently, the upper protective layer maintained in contact with the ink is required to have excellent film properties in heat resistance, mechanical properties, chemical stability, oxidation resistance, alkali resistance etc. For the material usable for such upper protective layer, in addition to the aforementioned Ta film, there are already known a precious metal, a high-melting transition metal, an alloy thereof, and a nitride, a boride, a silicide or a carbide of such metal, or amorphous silicon. For example, Japanese Patent Application Laid-open No. 2001-105596 proposes a recording head of a long service life and a high reliability by forming an upper protective layer on a heat-generating resistor through an insulation layer, and forming the upper protective layer with an amorphous alloy represented by $Ta_\alpha Fe_\beta Ni_\gamma Cr_\delta$ (wherein 10 atomic % (at. %)$\leqq\alpha\leqq$30 at. %, and $\alpha+\beta>80$ at. %, and $\alpha<\beta$, $\delta>\gamma$ and $\alpha+\beta+\gamma+\delta=100$ at. %) in which a surface thereof in contact with the ink includes an oxide of a constituent thereof.

However, a higher functionality such as a higher image quality and a higher recording speed for an image recorded by an ink jet recording apparatus is being required more strongly in recent years, and, in order to meet such requirement, there are desired an improvement in ink performance such as an improvement in color developing property and weather resistance for achieving a higher image quality and a prevention of a bleeding phenomenon (blotting between inks of different colors) in order to achieve a higher recording speed. For this reason, it has been tried to add various components to the ink. Also types of the ink have become diversified, such as light-colored inks of lower density in addition to black, yellow, magenta and cyan colors. Such inks cause a corroding phenomenon even on the Ta film, that has been considered stable as the upper protective film, by a thermal chemical reaction with such inks. Such phenomenon appears conspicuously in an ink containing a salt of a divalent metal such as Ca or Mg, or a component forming a chelate complex.

On the other hand, an upper protective layer with an improved corrosion resistance to the ink as explained above tends to generate a kogation more easily since the surface is scarcely damaged because of the higher corrosion resistance, whereby a discharge speed of the ink is lowered or becomes unstable. The kogation is generated little in the conventional Ta film presumably because the Ta film generates corrosion and kogation in a certain balanced level whereby the surface of the Ta film is abraded by such corrosion to suppress deposition of a product of kogation.

Also for achieving a further higher recording speed in the ink jet recording, it is necessary to further increase the drive frequency thereby executing a drive with shorter pulses. In such drive with shorter pulses, processes of heating, bubble generation, bubble extinction and cooling are repeated within a shorter period in the heat acting portion of the head, whereby a larger thermal stress is generated in a shorter time than in the conventional drive. Also in a drive with a shorter pulse, the cavitation impact resulting from the bubble generation and bubble contraction in the ink is concentrated in the upper protective film within a shorter time than in the conventional drive, whereby there is required an upper protective layer particularly excellent in the mechanical impact resistance.

For forming an ink jet head with an ink jet head substrate provided with such upper protective layer, there is employed, as disclosed in Japanese Patent Application Laid-open No. H6-286149, a method of forming an ink flow path with a soluble resin by a photolithographic patterning, then covering and hardening such pattern with an epoxy resin or the like, and eliminating such soluble resin after the substrate is cut into a piece.

It is also possible, as disclosed in Japanese Patent Application Laid-open No. 2002-113870, to achieve a higher durability and a higher reliability by constituting the upper protective layer with two layers, employing an amorphous Ta film of a high ink corrosion resistance as a lower layer and a Ta film of relatively low generation of kogation as an upper layer.

However, in case of elongating an ink discharge element (to 0.5 inches or larger) for achieving a higher recording speed or in case of employing diversified inks containing additives for improving a light fastness or a gas resistance of the inks on a recording medium, there are generated strains by a difference in the linear expansion coefficient of such components, and by a stress in the resin layer constituting walls of the liquid flow path or the discharge port, and an influence on the interface by inks of new types, thus leading to a peeling phenomenon between the covering resin layer constituting the walls of the liquid flow path or the discharge port and the upper protective layer on the heater substrate. Also, even in case an organic adhesion promoting layer is provided on the upper protective layer, there may result a peeling at the interface between the organic adhesion promoting layer and the upper protective layer to cause a penetration of the ink onto the substrate and to induce a corrosion of the wirings, thereby hindering satisfactory recording or reliability in quality over a prolonged period.

DISCLOSURE OF THE INVENTION

An object of the present invention is to improve adhesion between an upper protective layer of a substrate for an ink jet head, having a portion coming into contact with an ink, and a resin layer, thereby providing an ink jet head and a substrate therefor capable of ensuring reliability over a prolonged period.

Another object of the present invention is to provide a substrate for an ink jet head with an improved adhesion between an upper protective layer and resin layer even in case of a smaller dot for a higher definition of a recorded image or of a longer recording element for a higher recording speed or in case of employing diversified inks thereby enabling a higher density of the head, an ink jet head provided with such substrate, and a producing method thereof.

Another object of the present invention is to provide a configuration of an upper protective layer realizing a high durability and a high reliability even for highly corrosive inks, thereby providing a substrate for an ink jet head and an ink jet head of a long service life and a producing method thereof.

Another object of the present invention is to provide a substrate for ink jet comprising a base plate formed with a heat-generating resistor for generating energy for discharging ink, an electrode wiring electrically connected with said heat-generating resistor, and an upper protective layer provided above said heat-generating resistor and said electrode wiring, and comprising a TaCr alloy, wherein said upper protective layer is formed with a construction made by resin on an upper portion thereof and said resin construction is fixed on said upper protective layer.

Another object of the present invention is to provide an ink jet head comprising, a discharge port for discharging a liquid, a liquid flow path communicating with said discharge port and having a portion for applying thermal energy for discharging said liquid to said liquid, a heat-generating resistor for generating said thermal energy, an electrode wiring electrically connected with said heat-generating resistor, and an upper protective layer provided above said heat-generating resistor and said electrode wiring, and comprising a TaCr alloy, wherein said upper protective layer is formed with a construction made by resin on an upper portion thereof and said resin construction is fixed on said upper protective layer:

Another object of the present invention is to provide a producing method for an ink jet head including, on a substrate, a heat-generating resistor constituting a heat generating portion, an electrode wiring electrically connected with said heat-generating resistor, an upper protective layer provided on said heat-generating resistor and said electrode wiring and having a contact surface with an ink, and a liquid flow path member formed by a resin layer on said substrate, comprising, a step of forming an upper protective layer in which a Ta layer is laminated on a layer formed by a TaCr alloy, a step of selectively patterning said Ta layer and selectively removing said Ta layer, a step of forming the liquid flow path member in a portion where the layer formed by said TaCr alloy is exposed by said removing step.

Another object of the present invention is to provide a substrate for an ink jet head, having an excellent adhesion between an upper protective layer and a resin layer and enabling to form a pattern of a liquid flow path with a high precision thereby providing an ink jet head of a high reliability, also not causing a peeling of a member constituting a liquid flow path even in an ink jet head elongated to 0.5 inches or larger thereby ensuring a high reliability over a prolonged period, an ink jet head and a producing method thereof.

Another object of the present invention is to provide a substrate for an ink jet head enabling to form a pattern of a liquid flow path with a high precision by an excellent adhesion between an upper protective layer and a member constituting the liquid flow path, thereby ensuring a high reliability even in case of a smaller dot formation for achieving a higher definition in a recorded image or of a high-speed drive for achieving a high-speed recording, an ink jet head and a producing method thereof.

BEST MODE FOR CARRYING OUT THE INVENTION

Figure 1:
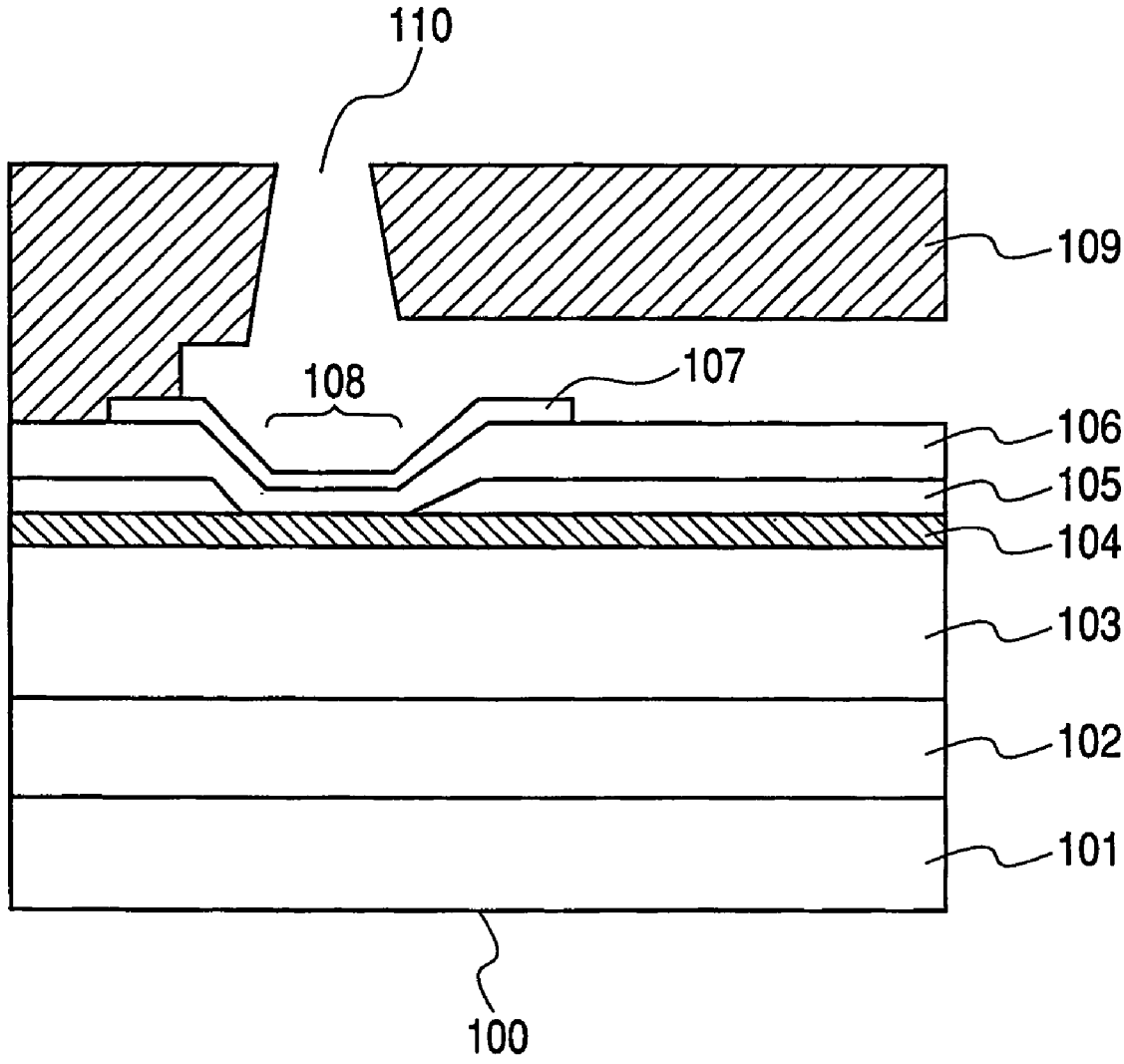
FIG. 1 is a partial cross-sectional view of a substrate for ink jet head of the present invention.
Figure 2A:
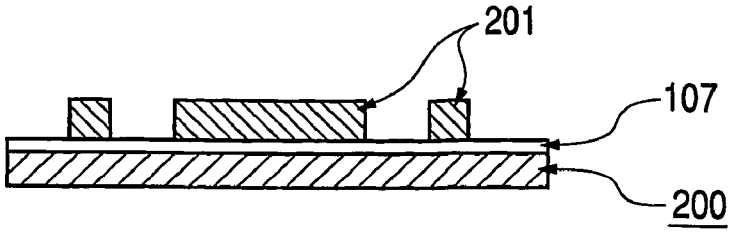
FIGS. 2A, 2B, 2C and 2D are views showing a method for forming a discharge element on the substrate for ink jet head of the present invention.
Figure 2B:
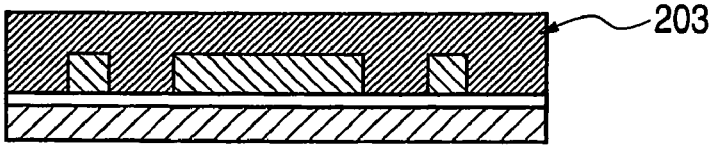
Figure 2C:
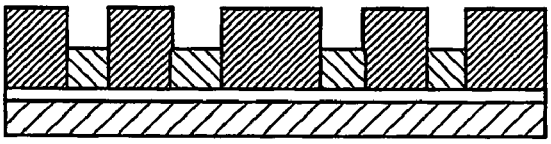
Figure 2D:
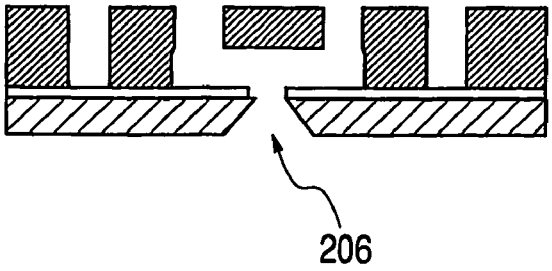
Figure 3A:
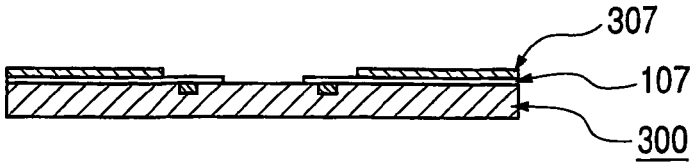
FIGS. 3A, 3B, 3C, 3D and 3E are views showing another method for forming a discharge element on the substrate for ink jet head of the present invention.
Figure 3B:
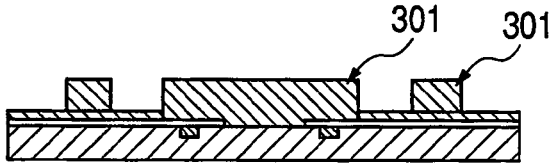
Figure 3C:
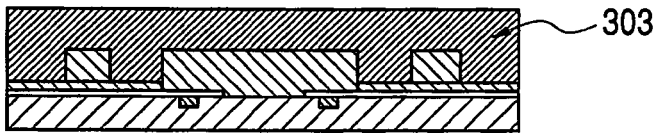
Figure 3D:
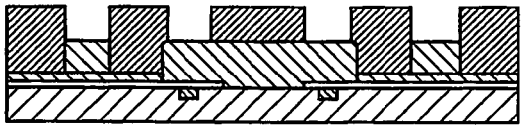
Figure 3E:
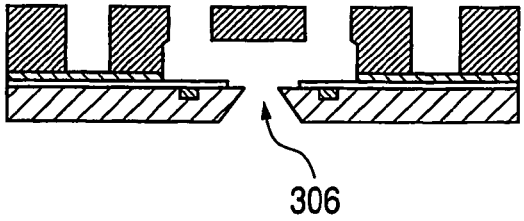

FIG. 1 is a schematic partial cross-sectional view showing an ink jet head in which a configuration of the present invention is applicable.

In FIG. 1, there are shown a silicon substrate 101, a heat accumulating layer 102 constituted of a thermal oxidation film, an interlayer film 103 constituted for example of an SiO film or an SiN film and also serving for heat accumulation, a heat-generating resistor layer 104, a metal wiring layer 105 constituted of a metal material such as Al, Al—Si or Al—Cu, a protective layer 106 constituted for example of an SiO film or an SiN film and also serving as an insulation film, an upper protective layer 107 provided on the protective layer 106 for protecting an electrothermal converting element from a chemical or physical impact associated with a heat generation of the heat-generating resistor, and a heat acting portion 108 in which a heat generated by a heat-generating resistor of the heat-generating resistor layer 104 is transmitted to ink.

The heat acting portion of the ink jet head is exposed to a high temperature resulting from heat generation by the heat-generating resistor, and is also principally subjected to a cavitation impact resulting from a bubble generation in the ink and a bubble contraction thereafter and a chemical action by the ink. For this reason, the upper protective layer 107 is provided on the thermal action portion in order to protect the electrothermal converting element from such cavitation impact and chemical action of the ink. On the upper protective layer 107, there is formed a discharge element including a discharge port 110, utilizing a member 109 for forming a flow path.

FIGS. 2A to 2D show a method for forming a discharge element.

On an ink jet head substrate 200, which is same as the ink jet head substrate 100 shown in FIG. 1, a resist material is coated by a spin coating method, as a soluble solid layer 201 for finally constituting an ink flow path. The resist material, constituted of polymethylisopropenyl ketone, functions as a negative-working resist and is patterned into a form of an ink flow path by a photolithographic method. Then a covering resin layer 203 is formed in order to form a wall of the ink flow path and a discharge port. Prior to forming the covering resin layer 203, a silane coupling process or the like may be suitably applied in order to improve adhesion. The covering resin layer 203 can be coated on the ink jet head substrate 200 bearing the pattern of the ink flow path, by suitably selecting an already known coating method. Then an ink supply aperture 206 is formed from a rear surface of the ink jet head substrate 200 by anisotropic etching, sand blasting or anisotropic plasma etching. The ink supply aperture 206 can be formed most preferably by chemical anisotropic etching of silicon utilizing tetrramethylhydroxylamine (TMAH), NaOH or KOH. Then, for eliminating the soluble solid layer 201, there are executed a flush exposure with a deep UV light, a development and a drying.

It is also possible, as shown in FIGS. 3A to 3E, after formation of an upper protective film 107 ($Ta_{100-x}Cr_x$ film), to form an organic adhesion promoting film 307 under the nozzle constituting member. As the organic adhesion promoting film 307, a polyether amide resin was selected. Such resin is particularly preferably because of an excellent resistance to alkali etching, a satisfactory adhesion to an organic film such as of silicon and an advantage of being usable as an ink-resistant protective film of the ink jet recording head. Thereafter a photolithographic process is applied to form a pattern as shown in FIGS. 3A to 3E. Such patterning can be achieved by a method similar to a dry etching of an ordinary organic film. More specifically, it can be achieved by an etching with oxygen gas plasma, utilizing a positive-working resist as a mask.

In the following, there will be explained, with reference to FIGS. 3A to 3E, a method of forming the organic adhesion promoting film 307 after the formation of the upper protective film 107 ($Ta_{100-x}Cr_x$ film). On an ink jet head substrate 300, a resist material is coated by a spin coating method to form a soluble solid layer 301 for finally constituting an ink flow path. The resist material, constituted of polymethylisopropenyl ketone, functions as a negative-working resist and is patterned into a form of an ink flow path by a photolithographic method.

Then a covering resin layer 303 is formed in order to form a wall of the ink flow path and a discharge port. Prior to forming the covering resin layer 303, a silane coupling process or the like may be suitably applied in order to improve adhesion. The covering resin layer 303 can be coated on a substrate for ink jet, on which the pattern of the ink flow path is formed, by suitably selecting an already known coating method. The coated covering resin layer 303 is patterned by a photolithographic process. Then an ink supply aperture 306 is formed from a rear surface of the substrate by anisotropic etching, sand blasting or anisotropic plasma etching. The ink supply aperture 206 is formed most preferably by chemical anisotropic etching of silicon utilizing tetrramethylhydroxylamine (TMAH), NaOH or KOH. Then, for eliminating the soluble solid layer 301, there are executed a flush exposure with a deep UV light, a development and a drying.

The substrate, bearing the nozzle portion formed through the steps explained in FIGS. 2A to 2D and 3A to 3E, is cut and separated with a dicing saw or the like into a chip, which is subjected to an electrical connection for driving the heat-generating resistor and an adjoining of an ink supply member, thereby completing an ink jet head.

The upper protective layer coming into contact with the ink, is required to have excellent film characteristics such as a heat resistance, mechanical properties, a chemical stability, an oxidation resistance and an alkali resistance, and an excellent adhesion to the organic adhesion promoting layer and the nozzle-constituting member, and is constituted of Ta and Cr. It is preferably constituted of $Ta_{100-x}Cr_x$ in which $x \geqq 12$ at. %.

A thickness of the upper protective layer 107 is selected within a range of 50 to 500 nm, preferably 100 to 300 nm. Also the upper protective layer has at least a compression stress, preferably not exceeding $1.0\times10^{10}$ dyn/cm$^2$. The upper protective layer 107 can be formed by various methods, but can generally be formed by a magnetron sputtering method utilizing a high frequency (RF) power source or a direct current (DC) power source.

Figure 4:
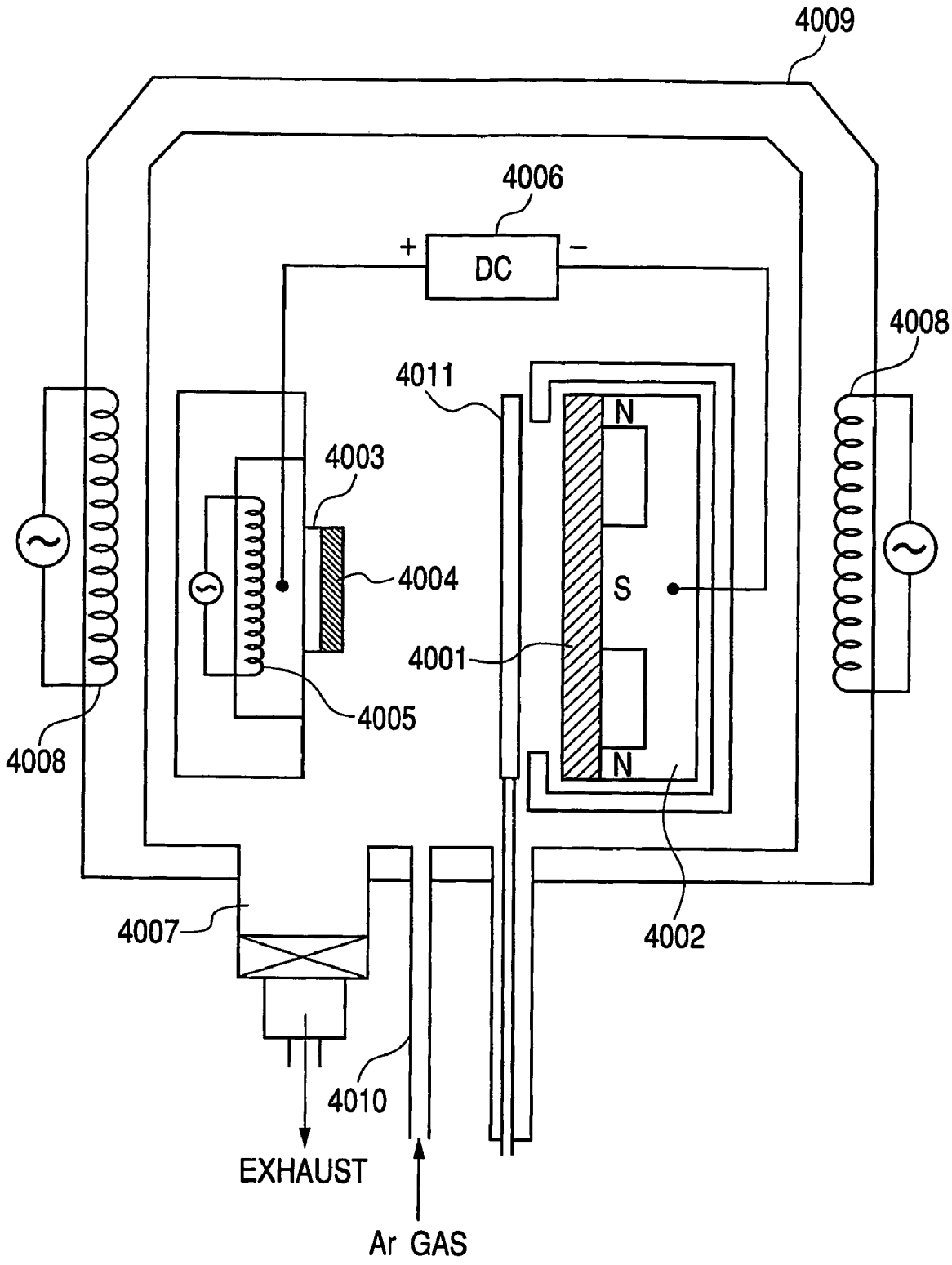
FIG. 4 is a view showing a film forming apparatus for forming layers of the substrate for ink jet head of the present invention.

FIG. 4 schematically shows a sputtering apparatus employed for forming the upper protective layer 107. In FIG. 4, there are shown a Ta target and a Cr target 4001, a flat magnet 4002, a shutter 4011 for controlling film formation on a substrate, a substrate holder 4003, a substrate 4004, and a power supply connected to the target 4001 and the substrate holder 4003. In FIG. 4, there is also shown an external heater 4008 provided around an external peripheral wall of a film forming chamber 4009. The external heater 4008 is used for regulating a temperature of an atmosphere in the film forming chamber 4009. At the rear of the substrate holder 4003, an internal heater 4005 is provided for regulating the temperature of the substrate. The temperature control of the substrate is preferably achieved in combination with the external heater 4008.

A film formation with the apparatus shown in FIG. 4 is executed in a following manner. At first the film forming chamber 4009 is evacuated by a vacuum pump 4007 to $1\times10^{-5}$ to $1\times10^{-6}$ Pa. Then Ar gas is introduced through a mass flow controller (not shown), into the film forming chamber 4009 via a gas introducing aperture 4010. In this operation, the internal heater 4005 and the external heater 4008 are so regulated that the substrate and the atmosphere become predetermined temperatures. Then an electric power is applied from the power supply 4006 to the target 4001 to cause a sputtering discharge, and the shutter 4011 is adjusted to form a thin film on the substrate 4004.

In the present invention, the film formation can be executed by a binary simultaneous sputtering utilizing a Ta target and a Cr target and applying electric powers thereto from two power sources respectively connected thereto. In such case, it is possible to independently regulate the electric power applied to each target. It is also possible to obtain a film of a desired composition by preparing plural alloy targets adjusted in advance to desired compositions and to execute sputtering with a single target or simultaneously with plural targets.

At the formation of the upper protective layer 107, a strong film adhesion can be obtained by heating the substrate to 100 to 300° C. as explained above. Also a strong film adhesion can be achieved by a film formation with a sputtering method capable of forming particles of a relatively high kinetic energy as explained in the foregoing.

Also a strong film adhesion can be obtained by providing the film at least with a compression stress, not exceeding $1.0\times10^{10}$ dyn/cm$^2$. Such film stress can be regulated by suitably setting a flow rate of the Ar gas introduced into the film forming apparatus, a power applied to the target and a heating temperature of the substrate.

Figure 5:
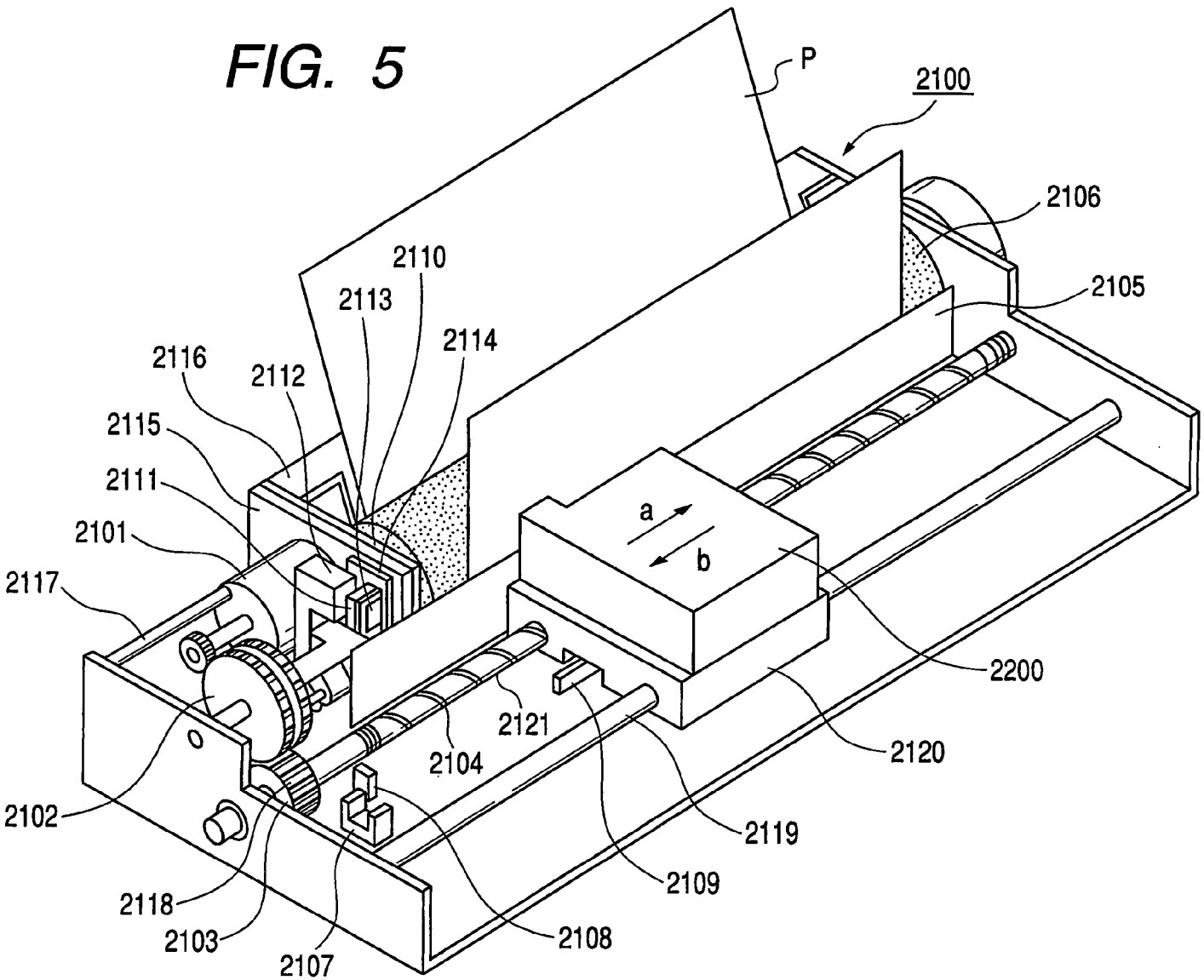
FIG. 5 is a schematic view showing a configuration of an ink jet recording apparatus in which the ink jet head of the present invention is applied.

FIG. 5 is an external view of an ink jet apparatus in which the present invention is applicable. This ink jet apparatus is of an old type, but the present invention is more effective when applied to an ink jet apparatus of a latest type.

In the ink jet apparatus shown in FIG. 5, a recording head 2200 is mounted on a carriage 2120 engaging with a spiral groove 2121 of a lead screw 2104 which is rotated through power transmission gears 2102, 2103 in linkage with a forward or reverse rotation of a driving motor 2101, and is reciprocated together with the carriage 2120 in directions a, b along a guide 2119, by the power of the driving motor 2101. A paper pressing plate 2105, for recording paper P conveyed on a platen 2106 by an unrepresented recording medium supplying apparatus, presses the recording paper to the platen 2106 along the moving direction of the carriage 2120.

Photocouplers 2107, 2108 constitute home position detecting means, for confirming presence of a lever 2109 of the carriage 2120 in the position of the photocouplers thereby switching the rotating direction of the driving motor 2101. There are also provided a member 2110 for supporting a cap member 2111 for capping an entire face of the recording head 2200, and suction means 2112 for suction removal of ink in the cap member 2111 thereby achieving a suction recovery of the recording head 2200 through an aperture 2113 in the cap. A cleaning blade 2114 and a movable member 2115 for supporting the cleaning blade in movable manner in front-rear direction are supported by a support plate 2116 in a main body of the apparatus. The cleaning blade 2114 is not limited to the illustrated form and any known cleaning blade can naturally be applicable.

A lever 2117 for starting a suction of a suction recovery operation is moved by a movement of a cam 2118 engaging with the carriage 2120, thereby controlling the driving power of the driving motor 2101 through transmission means such as a clutch. A recording control unit (not shown) for supplying a signal to a heat generating unit 2110 provided in the recording head 2200 and for controlling the function of the aforementioned mechanisms is provided in the main body of the recording apparatus.

The ink jet recording apparatus 2100 of the above-explained configuration executes a recording by a reciprocating motion of the recording head 2200 over an entire width of the recording paper P conveyed onto the platen 2106 by the recording medium supplying apparatus, and is capable of a high-speed recording of a high precision, as the recording head 2200 is prepared by a method explained in the foregoing.

In the following, the present invention will be clarified further by examples of formation of the upper protective layer 107 and of an ink jet head utilizing the same. However, the present invention is not limited by such examples.

The apparatus shown in FIG. 4 and the aforementioned film forming method were employed in forming a Ta—Cr film for the upper protective layer 107 on a silicon wafer, and properties of such film were evaluated. The film forming operations and the evaluation of the film properties are explained in the following. It is to be noted that an unintended element (contamination) contained in a completed film through the film forming process etc. is not included in the present invention.

[Film Forming Operation]

At first a thermal oxide film was formed on a monocrystalline silicon wafer, and such silicon wafer (substrate 4004) was placed on the substrate holder 4003 in the film forming chamber 4009 of the apparatus shown in FIG. 4. Then the interior of the film forming chamber was evacuated by the vacuum pump 4007 to $8\times10^{-6}$ Pa. Then, Ar gas was introduced from the gas introducing aperture 4010 into the film forming chamber 4009 and the interior thereof was adjusted to following conditions:

[Film Forming Condition]

substrate temperature: 200° C.

gas atmosphere temperature in film forming chamber: 200° C.

gas mixture pressure in film forming chamber: 0.6 Pa

Then, by a binary sputtering method utilizing a Ta target and a Cr target with a variable power to each target, a $Ta_{100-x}Cr_x$ film was formed with a thickness of 200 nm on the thermal oxide film of the silicon wafer, thereby obtaining samples 1 to 7.

[Evaluation of Film Properties]

A composition analysis was conducted on each of the obtained samples 1 to 7 by a Rutherford back scattering (RBS). Obtained results are shown in Table 1. As shown in Table 1, films of different compositions can be obtained by changing the powers supplied to the Ta and Cr targets.

TABLE 1

| Sample No. | Power [W] Ta | Power [W] Cr | Film composition [at. %] |
|---|---|---|---|
| 1 | 720 | 100 | $Ta_{88}Cr_{12}$ |
| 2 | 680 | 100 | $Ta_{86}Cr_{14}$ |
| 3 | 640 | 100 | $Ta_{82}Cr_{18}$ |
| 4 | 600 | 100 | $Ta_{80}Cr_{20}$ |
| 5 | 500 | 150 | $Ta_{70}Cr_{30}$ |
| 6 | 500 | 400 | $Ta_{45}Cr_{55}$ |
| 7 | 500 | 600 | $Ta_{27}Cr_{73}$ |

[Film Stress]

Then a film stress of each sample was measured from an amount of deformation of the substrate before and after the film formation. As a result, with an increase in the Cr concentration in the $Ta_{100-x}Cr_x$ film, the film stress tended to change from a compression stress to a tensile stress and a film adhesion tended to decrease. A strong film adhesion can be obtained by forming a film stress at least as a compression stress and not exceeding $1.0\times10^{10}$ dyn/cm$^2$.

[Adhesion with Resin]

EXAMPLE 1

In order to simply evaluate an adhesion between a $Ta_{88}Cr_{12}$ film 107 (representing a film with a composition ratio of Ta 88 at. % and Cr 12 at. %; hereinafter composition being represented in a similar manner) of the present example and an organic adhesion promoting film (polyether amide resin) 307, a tape peeling test was conducted after a pressure cooker test (PCT).

The tape peeling test was conducted in the following manner. On a silicon wafer bearing the upper protective layer 107, an organic adhesion promoting film (polyether amide resin) 307 was formed with a thickness of 2 μm, and squares of 1×1 mm in a checkerboard pattern of 10 (longitudinal)×10 (lateral)=100 squares were formed with a cutter knife on the organic adhesion promoting film 307. Then a PCT was conducted by immersion in an alkaline ink under conditions of 121° C. and $2.0265\times10^5$ Pa (2 atm.) for 10 hours. Thereafter, an adhesive tape was applied on the squares in the checkerboard pattern and peeled, and a number of squares peeled by the adhesive tape among 100 squares was investigated. As a result, a generally satisfactory result was obtained, though peeling was observed in about 15 squares among 100 (Table 2).

COMPARATIVE EXAMPLE 1

A method similar to that in Example 1 was employed to evaluate an adhesion between the Ta film and the organic adhesion promoting film (polyether amide resin) 307 after PCT, and the obtained result is shown in Table 2.

As shown in Table 2, a peeling was generated at the interface between the Ta film and the organic adhesion promoting film 307 after the PCT, clearing indicating a deterioration of the adhesion property.

EXAMPLES 2 TO 7

A method similar to that in Example 1 was employed to evaluate an adhesion of $Ta_{100-x}Cr_x$ films of different compositions after PCT, and the obtained results are shown in Table 2.

COMPARATIVE EXAMPLES 2 AND 3

A method similar to that in Example 1 was employed to evaluate an adhesion after PCT. Evaluations were made on $Ta_{20}Fe_{61}Cr_{14}Ni_5$ (Comparative Example 2) and $Ta_{87}Fe_{10}Cr_2Ni_1$ (Comparative Example 3), and the obtained results are shown in Table 2.

As will be apparent from these results, the $Ta_{20}Fe_{61}Cr_{14}Ni_5$ film and $Ta_{87}Fe_{10}Cr_2Ni_1$ film, conventionally employed as the upper protective film, could not provide a sufficient adhesion property because of the peeling at the interface between the upper protective layer 107 and the organic adhesion promoting film 307.

TABLE 2

| | Film composition [at. %] | Film thickness [nm] | Number of peelings (after PCT) |
|---|---|---|---|
| Ex. 1 | $Ta_{88}Cr_{12}$ | 200 | 15/100 |
| Ex. 2 | $Ta_{86}Cr_{14}$ | 200 | 8/100 |
| Ex. 3 | $Ta_{82}Cr_{18}$ | 200 | 0/100 |
| Ex. 4 | $Ta_{80}Cr_{20}$ | 200 | 0/100 |
| Ex. 5 | $Ta_{70}Cr_{30}$ | 200 | 0/100 |
| Ex. 6 | $Ta_{45}Cr_{55}$ | 200 | 0/100 |
| Ex. 7 | $Ta_{27}Cr_{73}$ | 200 | 0/100 |
| Comp. Ex. 1 | Ta | 200 | 100/100 |
| Comp. Ex. 2 | $Ta_{20}Fe_{61}Cr_{14}Ni_5$ | 200 | 66/100 |
| Comp. Ex. 3 | $Ta_{87}Fe_{10}Cr_2Ni_1$ | 200 | 100/100 |

As explained in the foregoing, the adhesion between the upper protective layer 107 and the organic adhesion promoting layer 307 after the PCT, in the $Ta_{100-x}Cr_x$ film, tended to become lower in a film with a low Cr content, and was within a satisfactory range in case X was equal to or higher than 12 at. %.

In addition to the aforementioned results in the presence of an adhesion promoting layer, similar results were obtained in the absence of the adhesion promoting layer, and it was identified that a $Ta_{100-x}Cr_x$ film ($X\geqq12$ at. %) was effective for the adhesion regardless of the presence or absence of the adhesion promoting layer.

[Evaluation of Ink Jet Properties]

EXAMPLE 8

In the present example, a Si substrate or a Si substrate in which a driving IC is formed is used for a sample for evaluating the ink jet properties. In case of a Si substrate, an $SiO_2$ heat accumulation layer 102 (FIG. 1) of a thickness of 1.8 μm is formed by thermal oxidation, sputtering or CVD, and, a Si substrate already having an IC is also subjected to a formation of an $SiO_2$ heat accumulation layer in a preparation process.

Then an $SiO_2$ interlayer insulation film 103 of a thickness of 1.2 μm was formed by sputtering or CVD. Then a $Ta_{40}Si_{21}N_{39}$ heat-generating resistor layer 104 of a thickness of 50 nm was formed by reactive sputtering employing a Ta—Si target. This operation was conducted at a substrate temperature of 200° C. Then an Al film for the metal wiring 105 was formed with a thickness of 200 nm by sputtering.

Then a patterning was executed by a photolithographic process to form a heat acting portion 108 of 26×26 μm in which the Al film was eliminated. Then an SiN insulating member of a thickness of 300 nm as a protective film 106 by plasma CVD.

Then, as an upper protective layer 107, a $Ta_{88}Cr_{12}$ film was formed with a thickness of 200 nm by sputtering under varying powers to a Ta target and a Cr target.

Then the upper protective layer 107 was patterned by dry etching.

Subsequently, in order to improve adhesion between the upper protective layer and a nozzle-constituting member, an organic adhesion promoting film (polyether amide resin) 307 was formed with a thickness of 2 μm, whereby an ink jet head substrate was obtained.

Such ink jet head substrate was employed in a producing method shown in FIG. 3 to prepare an ink jet head, which was subjected to a discharge durability test in an ink jet recording apparatus. The test was conducted with a driving frequency of 15 kHz and a pulse width of 1.0 μsec, and an abrasion of the upper protective layer 107 after $1.0\times10^8$ pulses was evaluated by a cross sectional observation by FIB. The driving voltage was $1.3\times V_{th}$, in which $V_{th}$ is a bubble generation threshold voltage for ink discharge. Also there was employed an ink including a nitrate group-containing divalent metal salt $Ca(NO_3)_2.4H_2O$ by about 4%.

As shown in Table 3, it was identified that, despite of a slight abrasion after continuous discharge up to $2.0\times10^8$ pulses, the upper protective layer was stable with stable discharge characteristics.

COMPARATIVE EXAMPLE 4

An ink jet head was prepared in the same manner as in Example 8, except that the upper protective layer 107 was prepared with a Ta film. Such ink jet head was subjected to a discharge durability test as in Example 1, and an obtained result is shown in Table 3. As shown in Table 3, the discharge became impossible before reaching $2.0\times10^8$ pulses in Comparative Example 4. An analysis conducted by disassembling the ink jet head proved that the corrosion reached the heat-generating resistor layer and caused a breakage thereof.

EXAMPLES 9 TO 16

Ink jet heads were prepared in the same manner as in Example 8, except that the upper protective layers 107 were prepared with compositions and thicknesses as shown in Table 3. Such ink jet heads were subjected to a discharge durability test as in Example 8, and obtained results are shown in Table 3.

COMPARATIVE EXAMPLES 5 AND 6

Ink jet heads were prepared in the same manner as in Example 8, except that the upper protective layers 107 were prepared with compositions and thicknesses as shown in Table 3.

Such ink jet heads were subjected to a discharge durability test as in Example 8, and obtained results are shown in Table 3.

As shown in Table 3, $Ta_{20}Fe_{61}Cr_{14}Ni_5$ (Comparative Example 5) showed scarce abrasion and was stable in the discharge durability test.

$Ta_{87}Fe_{10}Cr_2Ni_1$ (Comparative Example 6) showed a abrasion to about a half of the film thickness.

These results indicate followings.

As will be apparent from the results shown in Table 3, the stability of the upper protective layer 107 in the discharge durability test against abrasion is dependent on the composition of $Ta_{100-x}Cr_x$ film, and becomes superior as the Cr content increases. More specifically, the upper protective layer 107 is extremely stable against abrasion in case $X\geqq12$ at. % in the composition of the $Ta_{100-x}Cr_x$ film.

Also the upper protective film 107 preferably has a film thickness of 100 to 500 nm. A film thickness less than 100 nm may result in an insufficient protective ability against ink, while a film thickness exceeding 500 nm may hinder an efficient energy conduction from the heat-generating resistor layer to the ink, thus resulting in a large energy loss.

In these examples, it was possible to obtain excellent durability even with a film thickness of about 100 nm. As regards the film stress, at least a compression stress, not exceeding $1.0\times10^{10}$ dyn/cm$^2$ could provide a strong film adhesive force with an excellent durability.

As explained in the foregoing examples, it is rendered possible, by constituting the upper protective layer 107 with an alloy of Ta and Cr, by forming a resin (flow path-forming member 109) on the upper protective layer 107 and by fixing such resin on the upper protective layer 107, to provide an ink jet head substrate enabling to realize a higher density, an ink jet head provided with such substrate, and an ink jet apparatus equipped with such ink jet head.

TABLE 3

| Example | Film composition [at. %] | Film thickness [nm] | Abrasion in discharge durability test (after $2.0\times10^8$ pulses) |
|---|---|---|---|
| Ex. 8 | $Ta_{88}Cr_{12}$ | 200 | ± |
| Ex. 9 | $Ta_{86}Cr_{14}$ | 200 | + |
| Ex. 10 | $Ta_{82}Cr_{18}$ | 200 | + |
| Ex. 11 | $Ta_{80}Cr_{20}$ | 200 | + |
| Ex. 12 | $Ta_{80}Cr_{20}$ | 100 | + |
| Ex. 13 | $Ta_{80}Cr_{20}$ | 400 | + |
| Ex. 14 | $Ta_{70}Cr_{30}$ | 200 | + |
| Ex. 15 | $Ta_{45}Cr_{55}$ | 200 | + |
| Ex. 16 | $Ta_{27}Cr_{73}$ | 200 | + |
| Comp. Ex. 4 | Ta | 200 | − |
| Comp. Ex. 5 | $Ta_{20}Fe_{61}Cr_{14}Ni_5$ | 200 | + |
| Comp. Ex. 6 | $Ta_{87}Fe_{10}Cr_2Ni_1$ | 200 | ± |

EXAMPLE 17

In the present example, the upper protective layer 107 has a two-layered configuration, and, in the heat acting portion, there is employed a two-layered configuration constituted of an upper Ta layer 111 and a lower TaCr layer 112 while, under the flow path forming member 109, there is employed a one-layered configuration of the lower layer 112 only.

More specifically there is shown a case of employing a $Ta_{80}Cr_{20}$ film as the lower film 112 of the upper protective film 107 and a Ta film as the upper film 111.

The lower film 112 was formed by a binary sputtering utilizing a Ta target and a Cr target, with a composition of $Ta_{80}Cr_{20}$ and a thickness of 130 nm on the insulation layer. Conditions of binary sputtering were determined by analyzing the composition in advance by changing powers for Ta sputtering and for Cr sputtering. Also instead of binary sputtering, there may be executed a sputtering with a TaCr alloy target of a composition known in advance.

Thereafter the upper layer 111 was formed with a thickness of 100 nm by sputtering utilizing a Ta target. The film formation was executed in continuous manner in the same sputtering chamber.

Thereafter the Ta film constituting the upper layer 111 was patterned by an ordinary photolithographic process by steps of resist patterning (resist coating, exposure and development), Ta etching and resist stripping.

Figure 6:
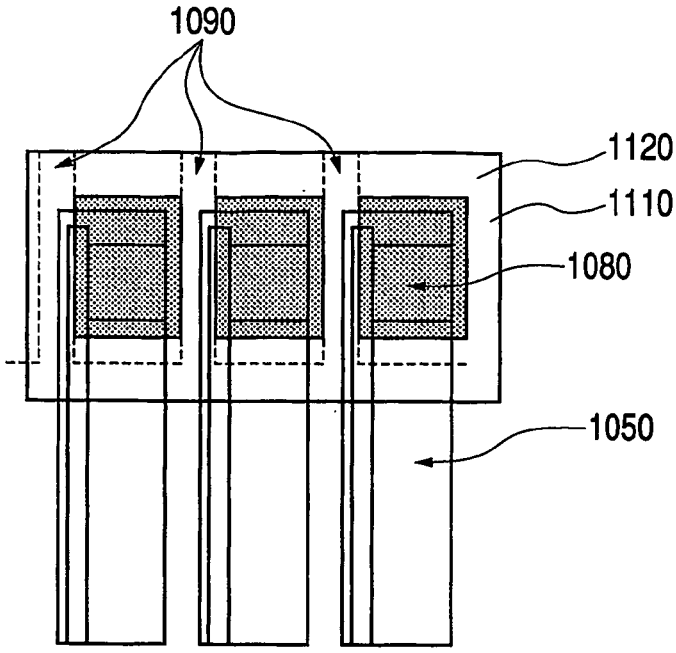
FIG. 6 is a partial plan view of another embodiment for forming a discharge element on the substrate for ink jet head of the present invention.
Figure 7:
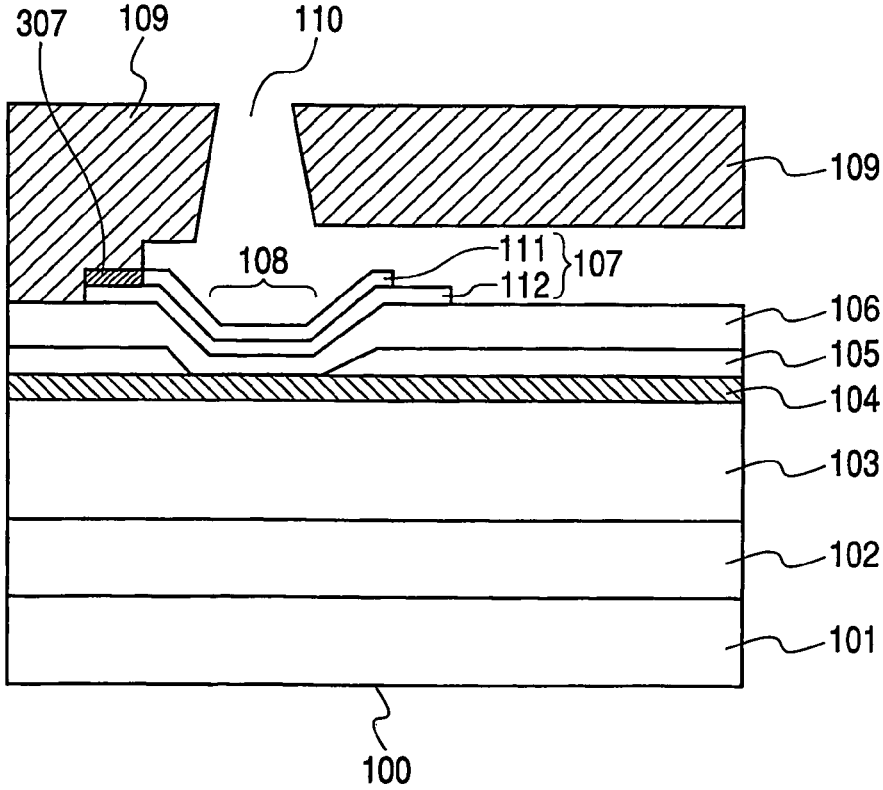
FIG. 7 is a schematic partial cross-sectional view of FIG. 6.
Figure 8:
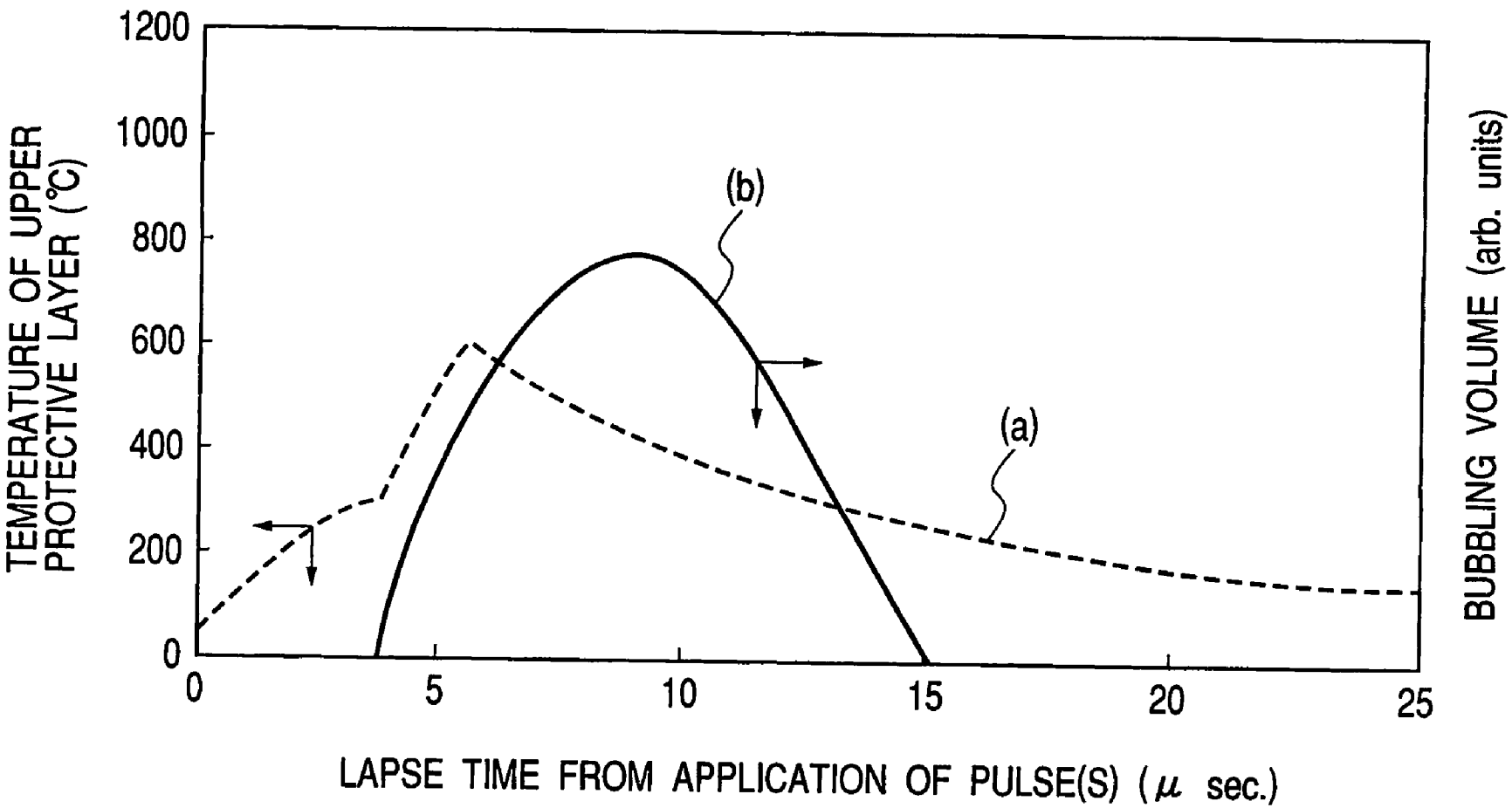
FIG. 8 is a chart showing a temperature change in an upper protective layer and a bubble generation state after a voltage application.

In this operation, the pattern of the Ta film can be arbitrarily selected by a photomask pattern at the exposure step. Therefore, the pattern was so selected as to form a Ta film on the heat generating part (heat acting portion 108) but not to form Ta film as the upper layer 111 where the liquid flow path forming member 109 is to be formed, as shown in FIGS. 6 and 7. Then the TaCr film was patterned by a photolithographic process by steps of resist patterning (resist coating, exposure and development), Ta etching and resist stripping. In FIG. 6, there are shown a low path member forming portion 1090 including, in a partial area, a configuration in which the flow path member 109 is laminated on the organic adhesion promoting layer 307, an upper layer pattern 1110 of the upper protective layer, a lower layer pattern 1120 of the upper protective layer, a heat generating resistor 1080, and an electrode wiring 1050.

The etching of the TaCr film was conducted with a dry etching apparatus, selecting an etching gas, a gas pressure and a power capable of achieving a selective etching ratio with the underlying insulating protective layer. In the formation of the pattern of the TaCr film, it was formed under the portion 1090 for forming the liquid flow path forming member as shown in FIG. 6.

Also as shown in FIG. 7 in a cross section, on the $Ta_{80}Cr_{20}$ film of a thickness of 230 nm constituting the lower layer film 112 of the upper protective layer 107, there were laminated an organic adhesion promoting film 307 constituting a lower liquid flow path member and a liquid flow path member 109 in this order, and the adhesion between the $Ta_{80}Cr_{20}$ film, and the organic adhesion promoting film 307 and the liquid flow path member 109 thereon in a simple manner. The evaluation was made by executing a tape peeling test in an initial state and after a pressure cooler test (PCT). The organic adhesion promoting film 307 as the lower liquid flow path member was employed in this example for the purpose of further improving the adhesion between the liquid flow path member 109 and the TaCr film.

The PCT was conducted by immersion in an alkaline ink under conditions of 121° C. and $2.0265\times10^5$ Pa. (2 atm.) for 10 hours. Obtained results are shown in Table 4. These results indicate that the $Ta_{80}Cr_{20}$ film had a satisfactory adhesion.

TABLE 4

| | Upper protective layer | Film thickness [nm] | Films formed above | Adhesion (initial) | Adhesion (after PCT) | Tape peeling test |
|---|---|---|---|---|---|---|
| Ex. 17 | TaCr | 230 | organic adhesion promoting layer/flow path member | + | + | + |
| Comp. Ex. 7 | Ta | 230 | organic adhesion promoting layer/flow path member | + | − | ± |

After the patterning of the $Ta_{80}Cr_{20}$ film constituting the lower layer 112 of the upper protective layer 107 and the Ta film constituting the upper layer 111, a soluble solid layer 301 was coated by a spin coating method on the substrate, and was exposed to form a shape to constitute an ink flow path. The shape of the ink flow path could be obtained with an ordinary mask and a deep UV light. Then a covering resin layer 303 was laminated, then exposed with an exposure apparatus and was developed to form a discharge port 110. Subsequently, after formation of an ink supply aperture 306 by an anisotropic etching of silicon with TMAH, a portion to be dissolved of the covering resin layer 303 was eliminated by a flush exposure to a deep UV light, a development and a drying. The substrate, bearing the nozzle portion formed through the steps explained in the foregoing, is cut and separated with a dicing saw or the like into a chip, which is subjected to an electrical connection for driving the heat-generating resistor and an adjoining of an ink supply member, thereby completing an ink jet head.

Thus prepared ink jet head provided a satisfactory recording quality in an evaluation of discharging an alkaline ink of pH 10. Also in case this ink jet head, after immersion in this ink for 3 months at 60° C., provided a satisfactory recording quality in an ink discharging evaluation, and did not show a peeling of the covering resin layer 303.

COMPARATIVE EXAMPLE 7

There is shown a case of employing a single-layered film of Ta only as the upper protective layer.

In the present comparative example, a Ta film of a thickness of 230 nm was formed by sputtering with a Ta target.

Thereafter the Ta film was patterned by an ordinary photolithographic process by steps of resist patterning (resist coating, exposure and development), Ta etching and resist stripping.

In this operation, the pattern of the Ta film can be arbitrarily selected by a photomask pattern at the exposure step.

In order to simply evaluate the adhesion between the Ta film of a thickness of 230 nm, and the liquid flow path member 109 and the organic adhesion promoting film 307 constituting the lower liquid flow path member, there was executed a tape peeling test. The evaluation was made by executing the tape peeling test in an initial state and after a pressure cooler test (PCT).

The PCT was conducted by immersion in an alkaline ink under conditions of 121° C. and $2.0265\times10^5$ Pa (2 atm.) for 10 hours. Obtained results are shown in Table 4.

Based on these results, in which the Ta film showed a peeling after the PCT, it was confirmed that the adhesion was superior in the configuration of the foregoing Example 17 employing $Ta_{80}Cr_{20}$ as the lower film 112 of the upper protective layer 107 and a Ta film as the upper layer film 111.

Thereafter, a soluble solid layer 301 was coated by a spin coating method on the substrate bearing the upper protective layer 107, and was exposed to form a shape to constitute an ink flow path. The shape of the ink flow path could be obtained with an ordinary mask and a deep UV light. Then a covering resin layer 303 was laminated, then exposed with an exposure apparatus and was developed to form a discharge port 110. Subsequently, after formation of an ink supply aperture 306 by an anisotropic etching of silicon with TMAH, a portion to be dissolved of the covering resin layer 303 was eliminated by a flush exposure to a deep UV light, a development and a drying. The substrate, bearing the nozzle portion formed through the steps explained in the foregoing, is cut and separated with a dicing saw or the like into a chip, which is subjected to an electrical connection for driving the heat-generating resistor and an adjoining of an ink supply member, thereby completing an ink jet head.

Thus prepared ink jet head provided a satisfactory recording quality in an evaluation of discharging an alkaline ink of pH 10. However, this ink jet head, when immersed in this ink for 3 months at 60° C., showed a portion of non-discharge and could not provide a satisfactory recording quality. In an observation of the ink jet head, a peeling of the covering resin layer 303 was observed and there was confirmed a connected state of the ink flow paths.

In this example, it is rendered possible, by forming a TaCr film in a lower layer, coming into contact with the liquid flow path member, of the upper protective film on the heater substrate, and by forming a Ta film in an upper layer coming into contact with the ink, to improve the adhesion between the upper protective layer and the resin layer constituting the liquid flow path even in case of a smaller dot for achieving a higher definition in the recorded image or of an elongated head for achieving a higher recording speed, or in case of employing diversified inks, thereby providing an ink jet head substrate and an ink jet head enabling to realize a higher density, and an ink jet apparatus equipped with such ink jet head.

Also a two-layered configuration of the upper protective layer realizes a high durability and a high reliability for diversified inks such as an ink showing a high discharge instability by kogation and an ink with a high corrosive property, thereby providing an ink jet head substrate and an ink jet head of a long service life, and an ink jet apparatus equipped with such ink jet head.

In the foregoing examples, there has been explained an ink jet recording head of which discharge elements such as a discharge port and an ink flow path are prepared by a photolithographic technology, but the present invention also includes a configuration in which an orifice plate constituting a discharge port or a top plate constituting an ink flow path is separately formed and adhered, for example, with an adhesive material, onto the upper protective layer.

The invention claimed is:

1. A substrate for an ink jet head comprising:

a base plate formed with a heat-generating resistor for generating energy for discharging ink;

an electrode wiring electrically connected with said heat-generating resistor; and a protective layer provided above said heat-generating resistor and said electrode wiring, said protective layer being constituted of a two-layered section formed by a lower layer of a TaCr alloy and an upper layer of Ta, and of a single-layered section having said lower layer, wherein a resin construction made by resin is formed on said lower layer of said single-layered section and said upper layer of said two-layered section is provided at a position in contact with ink at least above said heat-generating resistor.

2. The substrate according to claim 1, wherein said lower layer of said single-layered section fixes a flow path forming member as resin construction through an organic adhesion promoting layer.

3. The substrate according to claim 1, wherein said lower layer of said protective layer contains Cr in an amount equal to or higher than 12 atomic %.

4. The substrate according to claim 1, wherein said lower layer of said protective layer has an amorphous structure.

5. The substrate according to claim 1, wherein said lower layer of said protective layer has a thickness within a range of 50 to 500 nm.

6. The substrate according to claim 1, wherein said lower layer of said protective layer has a film stress which is at least a compression stress and is equal to or less than $1.0\times10^{10}$ dyn/cm$^2$.

7. A substrate for an ink jet head comprising:

a base plate formed with a heat-generating resistor for generating energy for discharging ink;

an electrode wiring electrically connected with said heat-generating resistor; and a protective layer provided above said heat-generating resistor and said electrode wiring, and constituted of a TaCr alloy containing Cr in an amount equal to or higher than 12 atomic %, a construction made by resin being formed on said protective layer.

8. The substrate according to claim 7, wherein said protective layer fixes a flow path forming member as resin construction through an organic adhesion promoting layer.

9. The substrate according to claim 7, wherein said protective layer has an amorphous structure.

10. The substrate according to claim 7, wherein said protective layer has a thickness within a range of 50 to 500 nm.

11. The substrate according to claim 7, wherein said protective layer has a film stress which is at least a compression stress and is equal to or less than $1.0\times10^{10}$ dyn/cm$^2$.

12. A substrate for an ink jet head comprising:

a base plate formed with a heat-generating resistor for generating energy for discharging ink;

an electrode wiring electrically connected with said heat-generating resistor; and a protective layer provided above said heat-generating resistor and said electrode wiring, and having a film stress which is at least a compression stress and is equal to or less than $1.0\times10^{10}$ dyn/cm$^2$, a construction made by resin being formed on said protective layer.

13. The substrate according to claim 12, wherein said protective layer fixes a flow path forming member as resin construction through an organic adhesion promoting layer.

14. The substrate according to claim 12, wherein said protective layer has an amorphous structure.

15. The substrate according to claim 12, wherein said protective layer has a thickness within a range of 50 to 500 nm.

16. An ink jet head comprising:

a construction made by a resin for forming a discharge port for discharging ink, and an ink flow path communicated with said discharge port and having a portion effecting the ink with thermal energy for discharging ink;

a base plate formed with a heat-generating resistor for generating energy for discharging ink;

an electrode wiring provided on said base plate and electrically connected with said heat-generating resistor; and a protective layer provided above said heat-generating resistor and said electrode wiring, said protective layer being constituted of a two-layered section formed by a lower layer of a TaCr alloy and an upper layer of Ta, and of a single-layered section having said lower layer, wherein a resin construction made by resin is formed on said lower layer of said single-layered section and said upper layer of said two-layered section is provided at a position in contact with ink at least above said heat-generating resistor.

17. The ink jet head according to claim 16, wherein said lower layer of said single-layered section fixes a flow path forming member as resin construction through an organic adhesion promoting layer.

18. The ink jet head according to claim 16, wherein said lower layer of said protective layer contains Cr in an amount equal to or higher than 12 atomic %.

19. The ink jet head according to claim 16, wherein said lower layer of said protective layer has an amorphous structure.

20. The ink jet head according to claim 16, wherein said lower layer of said protective layer has a thickness within a range of 50 to 500 nm.

21. The ink jet head according to claim 16, wherein said lower layer of said protective layer has a film stress which is at least a compression stress and is equal to or less than $1.0\times10^{10}$ dyn/cm$^2$.

22. An ink jet head comprising:

a construction made by a resin for forming a discharge port for discharging ink, and an ink flow path communicated with said discharge port and having a portion effecting the ink with thermal energy for discharging ink;

a base plate formed with a heat-generating resistor for generating energy for discharging ink;

an electrode wiring provided on said base plate and electrically connected with said heat-generating resistor; and a protective layer provided above said heat-generating resistor and said electrode wiring, and constituted of a TaCr alloy containing Cr in an amount equal to or higher than 12 atomic %, a construction made by resin being formed on said protective layer.

23. The ink jet head according to claim 22, wherein said protective layer fixes a flow path forming member as resin construction through an organic adhesion promoting layer.

24. The ink jet head according to claim 22, wherein said protective layer has an amorphous structure.

25. The ink jet head according to claim 22, wherein said protective layer has a thickness within a range of 50 to 500 nm.

26. The ink jet head according to claim 22, wherein said protective layer has a film stress which is at least a compression stress and is equal to or less than $1.0\times10^{10}$ dyn/cm$^2$.

27. An ink jet head comprising:

a construction made by a resin for forming a discharge port for discharging ink, and an ink flow path communicated with said discharge port and having a portion effecting the ink with thermal energy for discharging ink;

a base plate formed with a heat-generating resistor for generating energy for discharging ink;

an electrode wiring provided on said base plate and electrically connected with said heat-generating resistor; and a protective layer provided above said heat-generating resistor and said electrode wiring, and having a film stress which is at least a compression stress and is equal to or less than $1.0\times10^{10}$ dyn/cm$^2$, a construction made by resin being formed on said protective layer.

28. The ink jet head according to claim 27, wherein said protective layer fixes a flow path forming member as resin construction through an organic adhesion promoting layer.

29. The ink jet head according to claim 27, wherein said protective layer has an amorphous structure.

30. The ink jet head according to claim 27, wherein said protective layer has a thickness within a range of 50 to 500 nm.

31. A producing method for an ink jet head including a construction made by a resin for forming a discharge port for discharging ink, and an ink flow path communicated with said discharge port and having a portion effecting the ink with thermal energy for discharging ink; a base plate formed with a heat-generating resistor for generating energy for discharging ink; an electrode wiring provided on said base plate and electrically connected with said heat-generating resistor; and a protective layer provided above said heat-generating resistor and said electrode wiring, said protective layer being constituted of a two-layered section formed by a lower layer of a TaCr alloy and an upper layer of Ta, and of a single-layered section having said lower layer, wherein a resin construction made by resin is formed on said lower layer of said single-layered section and said upper layer of said two-layered section is provided at a position in contact with ink at least above said heat-generating resistor, comprising the steps of:

forming a protective layer in which a Ta layer is laminated on a layer formed by a TaCr alloy;

selectively patterning said Ta layer and selectively removing said Ta layer;

forming the ink flow path in a portion where the layer formed by said TaCr alloy is exposed by said removing.

32. A producing method for an ink jet head including a construction made by a resin for forming a discharge port for discharging ink, and an ink flow path communicated with said discharge port and having a portion effecting the ink with thermal energy for discharging ink; a base plate formed with a heat-generating resistor for generating energy for discharging ink; an electrode wiring provided on said base plate and electrically connected with said heat-generating resistor; and a protective layer provided above said heat-generating resistor and said electrode wiring, and constituted of a TaCr alloy containing Cr in an amount equal to or higher than 12 atomic %, a construction made by resin being formed on said protective layer, comprising the steps of:

forming a protective layer in which a Ta layer is laminated on a layer formed by a TaCr alloy;

selectively patterning said Ta layer and selectively removing said Ta layer;

forming the ink flow path in a portion where the layer formed by said TaCr alloy is exposed by said removing.

33. A producing method for an ink jet head including a construction made by a resin for forming a discharge port for discharging ink, and an ink flow path communicated with said discharge port and having a portion effecting the ink with thermal energy for discharging ink; a base plate formed with a heat-generating resistor for generating energy for discharging ink; an electrode wiring provided on said base plate and electrically connected with said heat-generating resistor; and a protective layer provided above said heat-generating resistor and said electrode wiring, and having a film stress which is at least a compression stress and is equal to or less than $1.0\times10^{10}$ dyn/cm$^2$, a construction made by resin being formed on said protective layer, comprising the steps of:

forming a protective layer in which a Ta layer is laminated on a layer formed by a TaCr alloy;

selectively patterning said Ta layer and selectively removing said Ta layer;

forming the ink flow path in a portion where the layer formed by said TaCr alloy is exposed by said removing.

* * * * *